US008833970B2

(12) United States Patent
Lopez Querol et al.

(10) Patent No.: US 8,833,970 B2
(45) Date of Patent: Sep. 16, 2014

(54) LAMP AND LIGHTING SYSTEM AND DEVICE USING NATURAL AND ARTIFICIAL LIGHT

(75) Inventors: Jordi Lopez Querol, Santa Pau (ES); Jaime Riba Picola, Sant Fruitos de Bages (ES)

(73) Assignees: Sol Tecnic Ecologic 2000, S.L., Santa Pau (ES); Montronic Vic, S.L., Vic (ES)

( * ) Notice: Subject to any disclaimer, the term of this patent is extended or adjusted under 35 U.S.C. 154(b) by 212 days.

(21) Appl. No.: 13/133,322

(22) PCT Filed: Dec. 1, 2009

(86) PCT No.: PCT/ES2009/070544

§ 371 (c)(1),
(2), (4) Date: Jun. 7, 2011

(87) PCT Pub. No.: WO2010/070169

PCT Pub. Date: Jun. 24, 2010

(65) Prior Publication Data

US 2011/0242810 A1 Oct. 6, 2011

(30) Foreign Application Priority Data

Dec. 18, 2008 (ES) ..... 200802575 U

(51) Int. Cl.

| | |
|---|---|
| ***F21S 4/00*** | (2006.01) |
| ***F21S 19/00*** | (2006.01) |
| *E04D 13/03* | (2006.01) |
| *F21S 11/00* | (2006.01) |
| *F21Y 101/02* | (2006.01) |

(52) U.S. Cl.

CPC ..... *E04D 13/03* (2013.01); *E04D 2013/0345* (2013.01); *F21S 11/00* (2013.01); *F21S 19/005* (2013.01); *F21Y 2101/02* (2013.01)

USPC ..... 362/249.02; 359/595

(58) Field of Classification Search

CPC ..... F21S 19/005; E04D 13/03

USPC ..... 362/249.02

See application file for complete search history.

(56) References Cited

U.S. PATENT DOCUMENTS

| | | | | |
|---|---|---|---|---|
| 4,539,625 | A | 9/1985 | Bornstein | |
| 2006/0007549 | A1 | 1/2006 | Zincone | |
| 2007/0273290 | A1 * | 11/2007 | Ashdown et al. | 315/113 |

(Continued)

FOREIGN PATENT DOCUMENTS

| | | | |
|---|---|---|---|
| CA | 2 337 293 | A1 | 8/2002 |
| WO | 00/32015 | A1 | 6/2000 |

OTHER PUBLICATIONS

International Search Report PCT/ES2009/070544, Mar. 22, 2010.

*Primary Examiner* — Britt D Hanley

(74) *Attorney, Agent, or Firm* — Sughrue Mion, PLLC

(57) ABSTRACT

The invention relates to a lamp (4) and to a lighting system and device (1) for lighting interiors such as dwellings or offices, the LED lamp (6) including an LED-supporting body (5) having a substantially circular or polygonal crown-shaped plan and provided with a plurality of LEDs on one of the surfaces thereof, which body defines a hollow inner space (17) through which natural light can pass via means (22) for conveying natural light provided on the device, such as, for example, segments of reflective tube (2,2') that convey natural light or an optical fiber (3*b*). The lighting system enables the transmission via a communication channel (13) of the signal generated by a transducer element (10), involving at least one element (11) for transmitting to the corresponding receiver elements (12) which modify the elements (7) that control each lamp.

18 Claims, 5 Drawing Sheets

(56) References Cited

U.S. PATENT DOCUMENTS

2008/0122364 A1* 5/2008 McClellan ..... 315/51
2008/0130288 A1* 6/2008 Catalano et al. ..... 362/294
2009/0085497 A1* 4/2009 Osborn ..... 315/294
2012/0134170 A1* 5/2012 Bracale ..... 362/555

* cited by examiner

LAMP AND LIGHTING SYSTEM AND DEVICE USING NATURAL AND ARTIFICIAL LIGHT

CROSS REFERENCE TO RELATED APPLICATIONS

This application is a National Stage of International Application No. PCT/ES2009/070544 filed Dec. 1, 2009, claiming priority based on Spanish Patent Application No. U 200802575 filed Dec. 18, 2008, the contents of all of which are incorporated herein by reference in their entirety.

TECHNICAL FIELD OF THE INVENTION

The invention relates to a lighting lamp, device and installation for lighting up interior spaces such as homes or offices.

BACKGROUND OF THE INVENTION

The use of natural light-conducting tubes, which allow capturing sunlight through a skylight and conducting it through the interior of the tubes, coated with a highly reflecting material to that effect, in order to be delivered to different interior lighting points, is known for lighting up the interior space of homes, offices and the like. It is thus possible to light up interior rooms using sunlight, with the consequent energy saving, since the generation of light using electric current is not necessary. Since the sun changes its position throughout the day, the light capturing skylight can be adapted by means of its orientation and the placement of optical lenses to optimize the capture of sunlight between dawn and twilight. Lighting up interior spaces during the hours in which there is sun is thus solved. Nevertheless, the light level may not be constant due to the passage of clouds or to the fact that the day is not sunny enough, and therefore the amount of captured light may not be enough for lighting up the interior rooms. Likewise, lighting up interior rooms during the night is not possible. To solve this drawback, the introduction of lighting elements in the light capturing tube has been suggested, such that in situations of insufficient lighting by the captured sunlight, this lack of light can be made up for by means of the use of incandescent lights such as bulbs or fluorescent lamps. Nevertheless, the use of this type of bulb results in a low efficiency of the energy use, since most of the energy is dissipated in the form of heat. Another drawback of this type of bulb is the space it occupies inside the natural light-conducting tube, preventing the passage of sunlight and therefore reducing the light level of the interior rooms during the hours of sun, in which the use of artificial lighting means is not necessary. Furthermore, the lifetime of the aforementioned light sources is limited, therefore when they burn out at the end of their service life they must be replaced with the consequent cost. Since this type of lamp is normally installed in ceilings and protected by means of diffuser lenses or glass, the bulb changing operation is furthermore difficult.

The use of high-power light-emitting diodes (LEDs) for lighting is also known, since it has advantages in terms of their energy efficiency and in terms of their consumption, which is considerably lower than that of known bulbs, in addition to having a much longer service life, up to the point in which their replacement during the service life of the lamp is not necessary. Nevertheless, high-power LEDs are highly sensitive to overheating and require working at relatively low temperatures. In the case of operating at a too high temperature, their service life time decreases drastically, being able to burn out immediately in high temperature situations. This means that their use inside natural light tubes is not possible because in order to maintain a good insulation between the interior and the exterior, natural light tubes are sealed and do not allow air exchange. Therefore, the heat dissipation level cannot be enough for the good operation of the LEDs.

The fact that LEDs work at the correct temperature is indispensable to assure their correct operation and prevent them from burning out, since high-power LEDs are usually welded to the lamp and their replacement is virtually impossible, the entire lamp having to be replaced or the intervention of a specialized technical service being required.

DISCLOSURE OF THE INVENTION

The LED lamp according to the invention has a particular application for lighting devices of those used to light up interior rooms by means of natural light to make up for the lack of natural light.

The lamp is essentially characterized in that it comprises an LED support body, having an essentially circular or polygonal annulus plan, provided with a plurality of LEDs in one of its faces, which determines an empty inner space through which conducted natural light can pass. The characteristic shape of said support body allows the passage of natural light through the central cavity determined by the circular or polygonal crown, allowing the light generated by the LEDs of the lamp to be able to compensate the lack of natural light.

In an embodiment variant, the LEDs are regularly distributed along the entire face of the LED support body, allowing the compensation of lack of natural light to be homogeneous.

According to another feature, the lamp comprises at least one controlling element suitable for modifying the power supply current of the LEDs. This modification of the power supply current of the LEDs allows controlling the light intensity generated by the LEDs to make up for the lack of natural light and can be used to regulate the light output to prevent overheating of the lamp which may damage the LEDs.

Preferably, the controlling elements are operable by means of a signal generated by a transducer element, the latter being able to be both manually operated, such as for example a switch, potentiometer or remote control, and automatically operated, such as a temperature sensor, a light intensity sensor for ambient light or a presence sensor.

In a variant of the invention, the LEDs have a power greater than 3 watts.

According to another feature of the invention, the lamp comprises a dissipation plate surrounding the LED support body (5), such that the entire perimeter of the circular or polygonal crown is thermally attached to the dissipation plate and the heat generated by the LEDs is effectively dissipated through the dissipation plate. The edges of the dissipation plate can be scalloped, whereby it has a larger surface of exposure of the dissipation plate to the air, allowing dissipating the heat generated by the LEDs more efficiently.

The lighting device of the present invention incorporates a lamp according to the invention and is essentially characterized in that it comprises natural light-conducting means, suitable for conducting natural light through the empty inner space of the support body of said lamp.

In a variant of the lighting device, the natural light-conducting means comprise a segment of natural light-conducting tube, the LEDs of the lamp being arranged essentially adjacent to the inner face of the mentioned segment of tube and partially distributed along the contour of the inner cross-section thereof, achieving, without considerably hindering the passage of natural light through the segment of tube, making up for the lack of natural light by means of the light emitted by the LEDs.

In an embodiment of interest, the support body is attached by abutment between two segments of natural light-conducting tube and in another embodiment the support body is tightly inserted inside a segment of natural light-conducting tube.

According to another feature, the lighting device comprises a dissipating sleeve applied against the outer face of the segment or segments of natural light-conducting tube, located at the level of the lamp, whereby it is achieved that the heat generated by the LEDs is transmitted to the dissipating sleeve.

In a variant of the invention, the natural light-conducting means comprise an optical fibre segment conducting natural light through the empty inner space of the support body of the lamp.

The lighting installation according to the invention comprises at least one lamp and is essentially characterized in that the signal generated by the transducer element is transmitted through a communication channel, by means of the intervention of at least one emitter element and a corresponding receiver element, achieving remotely sending information to act on the lamps. It is thus even possible for a plurality of lamps to share the information generated by one and the same transducer element.

BRIEF DESCRIPTION OF THE DRAWINGS

Embodiment variants of the invention are shown in the attached drawings by way of non-limiting example. In said drawings.

DETAILED DESCRIPTION OF THE DRAWINGS

In view of the figures, it can be observed that the lamp 4 object of the invention contains a plurality of high-power LEDs 6, in addition to electronic controlling elements 7 for switching it on and protection against possible overheating situations which could damage the LEDs 6.

Figure 1A:
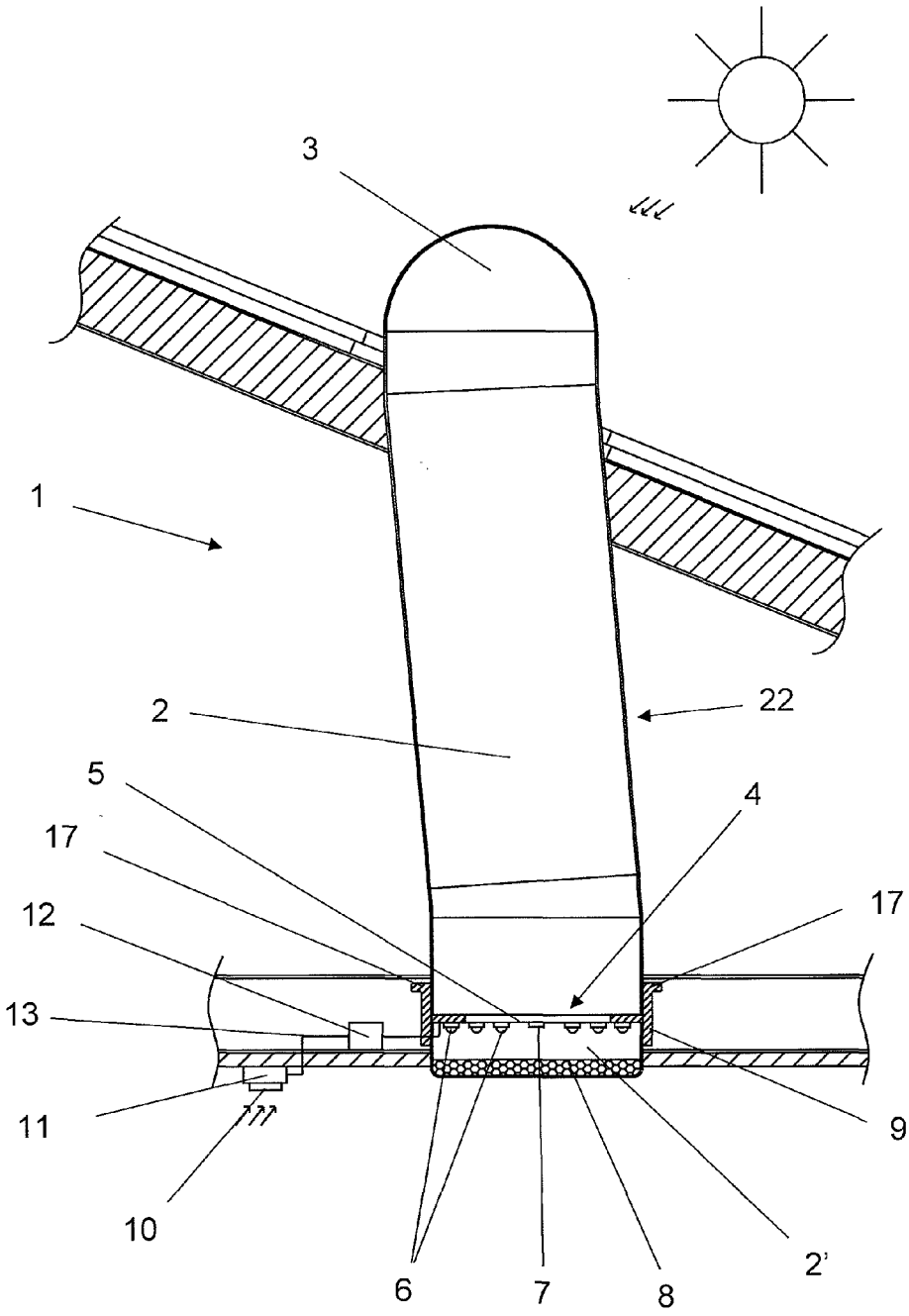
FIG. 1*a* depicts a section view of a variant of the lighting device incorporating the lamp according to the invention.

FIG. 1*a* shows a section view of a lighting device 1 comprising a segment of upper light-conducting tube 2 capturing light from the sun through a skylight 3, and comprising a lamp 4 of high-power LEDs 6 and a lower segment of tube 2'. The segment of light-conducting tube 2 can also be formed by different subsegments and branches, as is known in the state of the art, such that its path can be adapted as necessary. The lamp 4 of LEDs 6 is assembled between the segments of light-conducting tube 2 and 2' such that it does not prevent the passage of sunlight coming from the skylight 3. The fact that the lighting device 1 incorporates a lamp 4 of LEDs 6 allows lighting up an interior room not only by means of sunlight, but also in partial or complete darkness situations such as bad weather, cloudy weather or even at night. The lighting device 1 can thus make up for the lack of sunlight with the artificial light produced by the lamp 4 of LEDs 6.

The lighting device 1 furthermore allows, advantageously and automatically, making up for a partial lack of light by means of the use of transducer elements 10 sensitive to the brightness level which allow regulating the light output of the LEDs 6 such that the light level of the interior room is constant regardless of the sunlight level. In order to maintain a constant light level, the transducer element 10 captures the light level of the room and acts on the emitter element 11, which transmits to the receiver element 12 by means of the communication channel 13 a signal so that the receiver element 12 acts on the controlling element 7 of the lamp 4 to establish the desired light level of the LEDs 6, such that making up for the lack of natural light is achieved, maintaining a constant lighting of the interior room.

Said support body 5 is fixed to the segment of light-conducting tube 2 by known support means, such as screws, clamps or rivets. In order to improve the efficiency of light conduction in the segment going from the lamp 4 to the interior room, another segment of tube 2' of the same type as the one forming the segment of tube 2 is placed. The end of the segment of tube 2' is furthermore sealed and provided with a protective glass 8 to protect the lamp 4 of LEDs 6 and prevent the entrance and exit of air, which would affect the insulation of the room. The protective glass 8 can also comprise optical means for allowing the scattering and directing of the light beam, such as Fresnel lenses. Other protective means of those known in the state of the art can also be used instead of the glass 8 to protect the lamp 4. Naturally, the lamp 4 could also be installed in the terminal end of the segment of tube 2'.

The support body 5 of the lamp 4 has a general circular or polygonal crown shape and the high-power LEDs 6 are preferably uniformly distributed in the entire length of the support body 5, such that not only is a better distribution of the light beam generated by the LEDs 6 achieved, but the heat generated by the LEDs 6 is better distributed without creating hot spots which could damage nearby LEDs 6.

The lamp 4 of LEDs 6 dissipates the heat generated by the LEDs 6 through the segment of tube 2 and the segment of tube 2', preferably formed from aluminium or another conducting material, such that they can act as a heat dissipater. The air inside the segments of tube 2, 2' can also act as a heat dissipating means, although since they are sealed for reasons of heat insulation between the interior room and the exterior, the heat generated by the lamp 4 is mostly dissipated by means of the body of the segments of tube 2, 2'. To improve the heat dissipation, the lamp 4 comprise a dissipating sleeve 9, attached to the support body 5 and applied around the outer face of the segments of light-conducting tube 2, 2' and located at the level of the lamp 4 such that the dissipation of the heat generated by the lamp 4 is improved. Furthermore, in the event that the dissipation means do not achieve maintaining a suitable working temperature, and to prevent the overheating of the LEDs 6 of the lamp 4, the lighting device 1 is advantageously provided with controlling elements 7 which allow regulating the light intensity of the LEDs 6. In the example of FIG. 1*a*, the controlling elements 7 are assembled in the support body 5 of the LEDs 6 itself. Naturally, the invention also contemplates the possibility of the controlling elements 7 being located outside the lamp 4, likewise being connected to the LEDs 6.

Due to the fact that the greater the light output emitted by the LEDs 6, the greater is the heat generated by the LEDs 6, the lamp 4 incorporates temperature sensors monitoring the working temperature of the LEDs 6, acting on the controlling elements 7 in the event of exceeding the safety temperature of the LEDs 6 to temporarily limit the light output and favour the temperature reduction of the assembly until re-establishing a safe temperature level for the operation of the LEDs 6. The LEDs 6 are preferably powered by means of a square pulse train with a variable working cycle variable, at a high enough frequency so that the efficient light output emitted by the LEDs 6 can be varied, without said pulses being perceivable to the human eye, such that when the controlling element 7 increases the working cycle of the pulse train an increase of the light output generated by the LEDs 6 is perceived, and when the controlling element 7 reduces the working cycle of the square pulse train, a reduction of the light output generated by the LEDs 6 is perceived. Therefore, when the temperature sensors, which can be integrated with the controlling elements 7 like an integrated circuit, detect that the temperature of the lamp 4 exceeds the safety temperature for the good operation of the LEDs 6, they act on the controller to temporarily reduce the working cycle of the pulse train and, therefore, the light output of the LEDs 6 preventing the overheating of the lamp 4. This can occur when the sleeve 9 cannot dissipate enough heat to maintain the working temperature of the LEDs 6 of the lamp 4 under the safety threshold for the good operation of the LEDs 6.

Figure 1B:
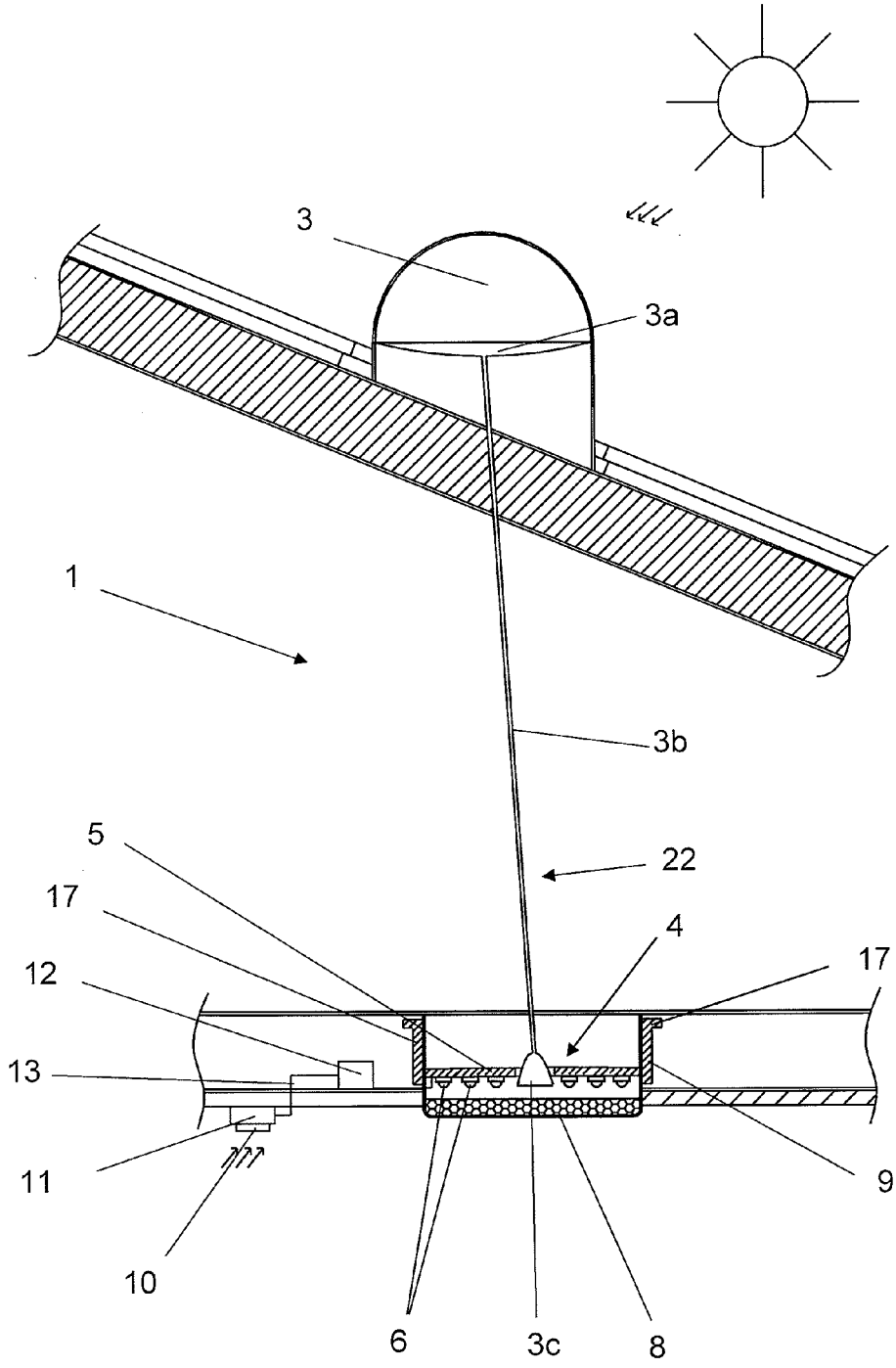
FIG. 1*b* depicts a section view of another variant of the lighting device incorporating the lamp according to the invention.

FIG. 1*b* shows a variant of the lighting device 1 in which the natural light-conducting means 22 comprise an optical fibre portion 3*b*. As can be observed, the skylight 3 has natural light capturing means 3*a* suitable for concentrating, by means of known optical techniques, the natural light captured through the skylight 3 and injecting it into an optical fibre segment 3*b* through which the natural light travels confined through the empty inner space 17 of the support body 5 of the lamp of LEDs 6 to known scattering means 3*c* which could even be arranged in said inner space 17. The optical fibre segment 3*b* can comprise a lattice of multiple optical fibre strands to increase the amount of transmitted light. The use of the optical fibre segment 3*b* instead of a larger segment of tube 2 is advantageous when there is not enough space to pass a segment of tube 2 from the skylight 3 to the lamp 4, it being even possible to completely dispense with the segments of tube 2, 2' by coupling the lamp 4 directly in the final portion of the conducting means 22, as observed in FIG. 1*b*. Indeed, although the amount of transmitted natural light can be lower, it is occasionally preferably to choose a more compact solution, despite the fact that light emitted by the lamp 4 must be increased to compensate the lack of natural light. Naturally, the lighting device 1 could combine optical fibre segments 3*b*, with their corresponding capturing means 3*a* and scattering means 3*c*, with segments of tube 2, 2' as appropriate.

Figure 2A:
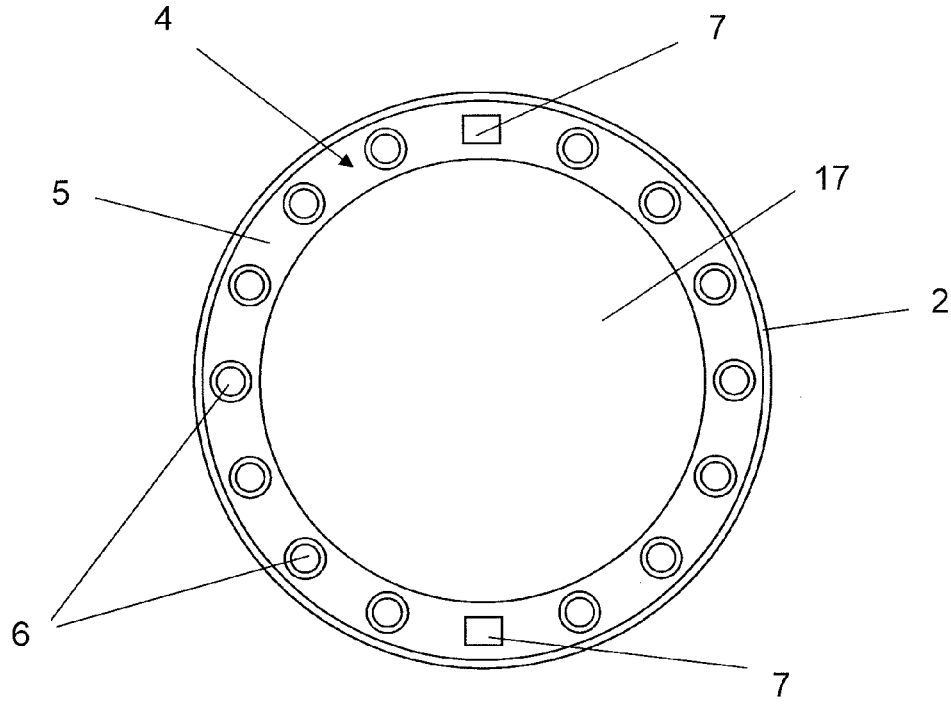
FIG. 2*a* depicts a plan view of a variant of the lamp according to the invention installed in a cross-section of a lighting device of FIG. 1*a;*
Figure 2B:
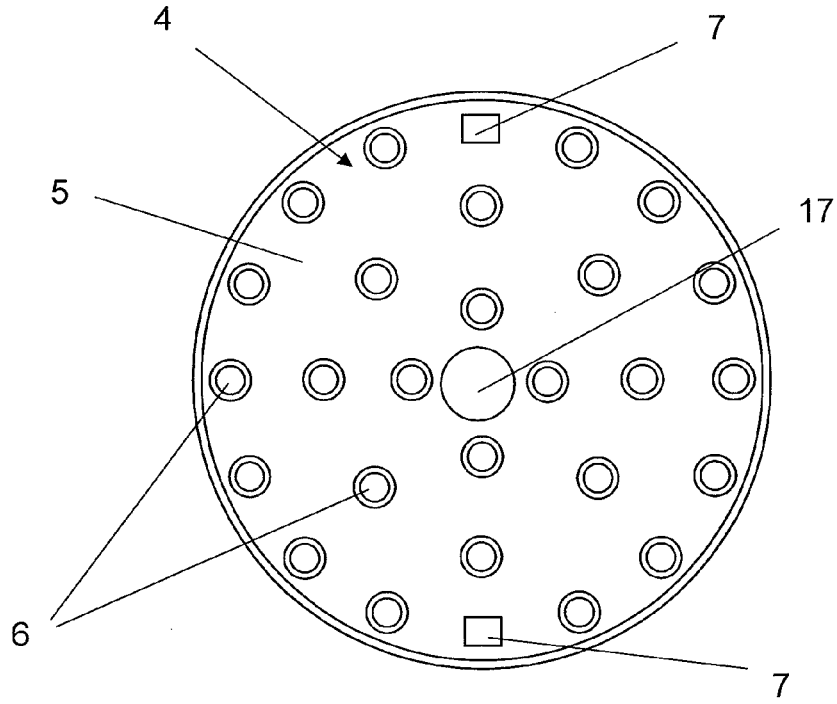
FIG. 2*b* depicts a plan view of another variant of the lamp.
Figure 3:
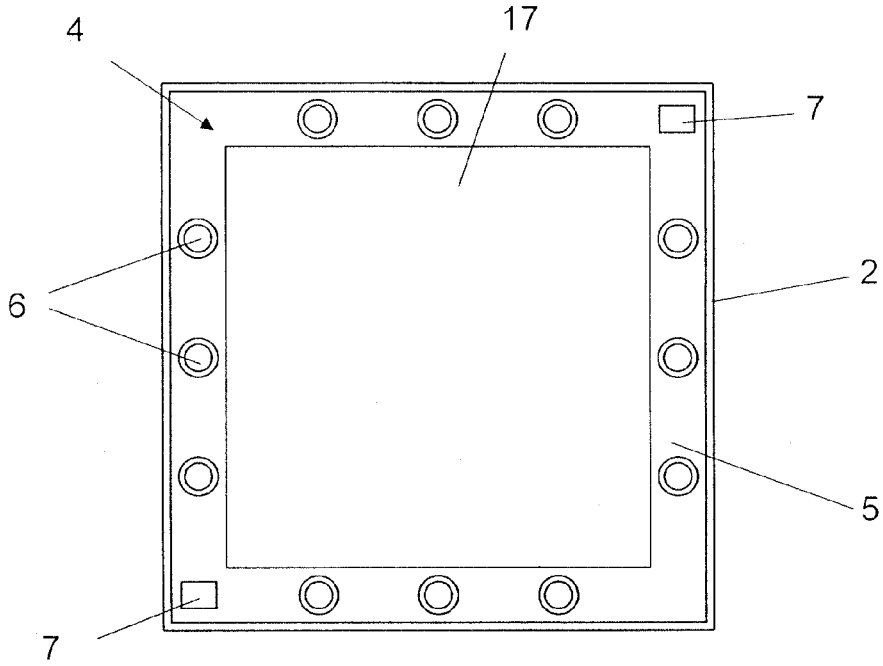
FIG. 3 depicts a plan view of another variant of the lamp according to the invention installed in a cross-section of a lighting device.

As can be observed in FIGS. 2*a*, 2*b* and 3, the LEDs 6 are distributed in the entire length of the support body 5 of the lamp 4, to achieve a good lighting up of the interior room in situations in which the sunlight coming from the skylight 3 is not enough. Furthermore, the lamp 4 is suitable for tightly fitting in the inner face of the segment of light-conducting tube 2, the latter being able to have a circular section, as in FIG. 2*a*, or a square section, as in FIG. 3. The variant of the lamp 4 shown in FIG. 2*b* has a considerably smaller inner space 17 than the variants shown in FIGS. 2*a* and 3, therefore it allows having a larger number of LEDs 6, being especially suitable for being installed in the lighting device 1 shown in FIG. 1*b*, in which the natural light passing through the empty inner space 17 of the lamp is confined in the optical fibre segment 3*b*.

In the event that, due to irregularities in the shape of the segments of tube 2, 2', the lamp 4 is not completely tightly fitted or to increase the heat dissipation efficiency, it is possible to use adhesives with a high thermal conductivity of those known in the state of the art to optimize the contact between the support body 5 and the segments of tube 2, 2'. Other geometries of the segments of natural light-conducting tube 2, 2' are also possible depending on the type of installation, and therefore the lamp 4 would have to adapt to the contour of the inner face of the light-conducting tube 2 to thus be tightly fitted and to optimize the transmission of heat generated by the lamp 4 to the segments of natural light-conducting tube 2, 2'.

Figure 4:
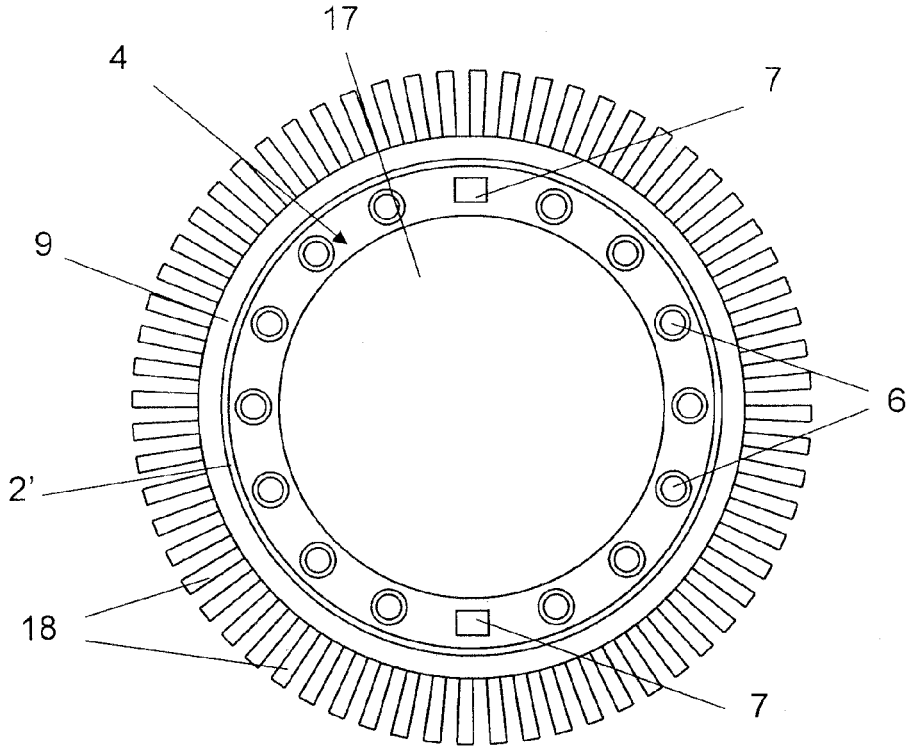
FIG. 4 depicts a plan view of another variant of the lamp according to the invention, incorporating a dissipation plate, installed in a cross-section of a lighting device.
Figure 5:
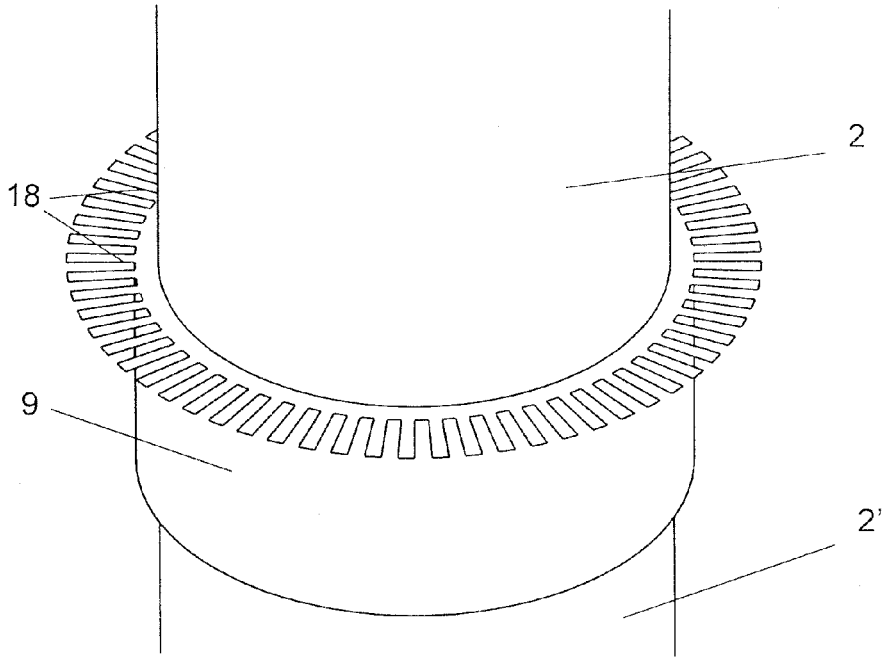
FIG. 5 depicts an enlarged perspective view of a device incorporating a lamp according to the invention and a dissipation plate.

FIG. 4 shows a view of the cross-section of the lighting device 1 of FIG. 1*a*, in which it can be observed how the LEDs 6 of the lamp 4 are located inside the segments of natural light-conducting tube 2, 2' which furthermore incorporates a dissipating sleeve 9 which adapts to the outer face of the segments of tube 2, 2'. The dissipation of the heat generated by the lamp 4 is thus improved and it is favoured that the LEDs 6 work at a temperature under the safety threshold without requiring acting on the controlling elements 7 to limit the light output of the LEDs 6. The dissipating sleeve 9 can have different shapes to thus improve the dissipation level. For example, the sleeve 9 of FIGS. 4 and 5 has in its upper edge a scalloping like multiple flanges 18, which are identical and projecting outwardly, equidistant from one another and which favour the heat exchange and therefore the dissipation of the heat generated by the LEDs 6 of the lamp 4. Similarly to the lamp 4, the dissipating sleeve 9 must adapt to the different geometries which the outer face of the segments of tube 2, 2' may have. Therefore, although FIGS. 4 and 5 show a dissipating sleeve 9 adapted to segments of tube 2, 2' with a circular section, other geometries are also possible. The dissipating sleeve 9 is installed between the segments of tube 2, 2' at the same level as the lamp 4, such that the dissipation of the heat generated by the LEDs 6 of the lamp 4 is optimized.

Figure 6:
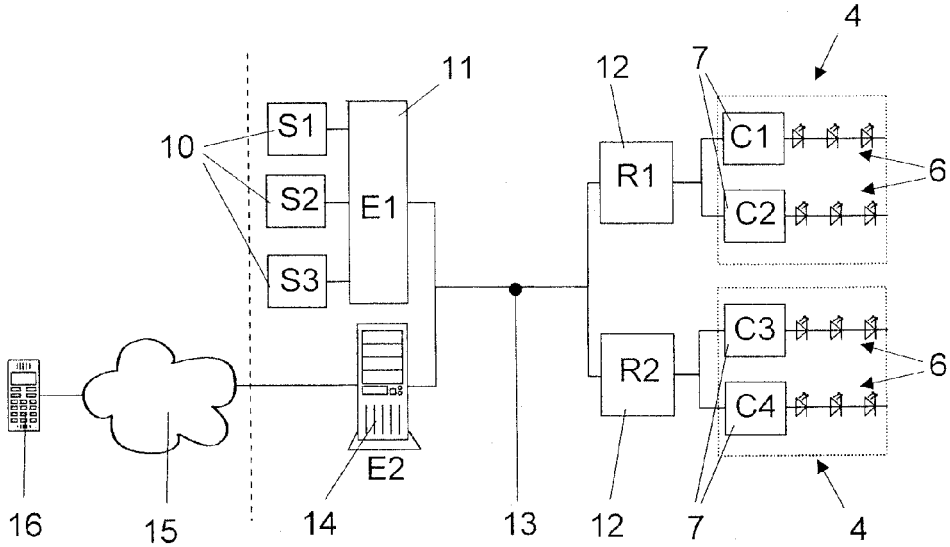
FIG. 6 depicts a diagram of an installation comprising two lamps according to the invention.

In order for the user to modify the brightness levels of the interior room, there is an installation such as that shown in FIG. 6. The desired brightness level is configured through the information collected by the transducer elements 10, which can be manual such as switches, potentiometers or remote controls, or automatic such as ambient light or presence sensors and is transmitted through the emitter elements 11 to the receiver elements 12 by means of a communication channel 13.

The emitter elements 11 and receiver elements 12 are designed so that they can communicate by means of a pre-established protocol through the communication channel 13, such as for example the digital protocol EIA-485.

It is also possible to transmit the desired brightness level by means of remote elements 16 which integrate transducers 10 and emitters 11, such as computers or telephones, using as a communication network 15, networks such as the switched telephone network or an IP network (LAN, Internet . . . ). The information collected and sent by the remote elements 16 is received and processed by adapter elements 14, which convert the incoming signal into a signal that can be interpreted by the receiver elements 12 and inject said signal into the communication channel 13.

By means of the described lighting installation, the brightness level of the lamps 4 can be locally or remotely selected. The receiver elements 12 decode the received signal and act on the controlling elements 7 by establishing the brightness level of the LEDs 6 according to the received data.

Naturally, the installation of the lighting devices 1 also contemplates the inclusion and adaptation of domotic systems of those commonly known and used by the persons skilled in the art.

The invention claimed is:

1. A lighting device, comprising:

an LED support body, the support body having an annular configuration defining a lower essentially circular or polygonal annulus face provided with a plurality of high-power LEDs, the support body being flat with a bottom face and defining an empty inner space through which conducted natural light can pass; and natural light-conducting means for conducting natural light through the empty inner space of the support body; and wherein the natural light-conducting means comprises a segment of natural light-conducting tube, the bottom face of the support body facing a downstream direction of the light-conducting tube and the LEDs arranged on the bottom face and essentially adjacent to an inner face of said segment of tube and distributed along a contour of the inner cross-section thereof; and the lighting device further comprising a second segment of natural light-conducting tube and wherein the support body is attached by abutment between the two segments of natural light-conducting tube and extending perpendicularly to walls of the two segments, the external edge of the support body being aligned with the external wall of the natural light-conducting tube.

2. The lighting device according to claim 1, wherein the LEDs are regularly distributed along the entire lower face of the LED support body.

3. The lighting device according to claim 1, further comprising at least one controlling element suitable for modifying the power supply current of the LEDs.

4. The lighting device according to claim 3, characterized in that the controlling elements are operable by means of a signal generated by a transducer element.

5. The lighting device according to claim 4, characterized in that the transducer element is manually operated.

6. The lighting device according to claim 4, characterized in that the transducer element is a temperature sensor or a light intensity sensor.

7. The lighting device according to claim 1, characterized in that the LEDs have a power greater than 3 watts.

8. The lighting device according to claim 1, characterized in that the lamp comprises a heat dissipating sleeve surrounding the LED support body.

9. The lighting device according to claim 1, further comprising a dissipating sleeve applied against the outer face of the segment of natural light-conducting tube, located at the level of the lamp.

10. The lighting device according to claim 1, characterized in that the natural light-conducting means comprise an optical fibre segment that passes through the empty inner space of the support body.

11. The lighting device according to claim 4, characterized in that the signal generated by the transducer element is transmitted through a communication channel by means of the intervention of at least one emitter element to the corresponding receiver elements.

12. The lighting device of claim 1, wherein the support body is tightly held against the one or more walls of the segment of natural light-conducting tube or the second segment of natural light-conducting tube to increase the efficiency of heat dissipation from the support body.

13. The lighting device of claim 1, wherein the segment of natural light-conducting tube is sealed to prevent air exchange between an inside and an outside of the segment of natural light-conducting tube.

14. The lighting device according to claim 1, wherein the LED support body defines a hoop with an external edge, the width of said external edge being smaller than the width of the hoop.

15. The lighting device according to claim 1, wherein the LED support body is rigid.

16. The lighting device according to claim 8, wherein the dissipating sleeve is attached to the LED support body.

17. A lighting device, comprising:

an LED support body, the support body having an annular configuration defining a lower essentially circular or polygonal annulus face provided with a plurality of high-power LEDs, the support body being flat with a bottom face and defining an empty inner space through which conducted natural light can pass;

natural light-conducting means for conducting natural light through the empty inner space of the support body; wherein the natural light-conducting means comprises a segment of natural light-conducting tube, the bottom face of the support body facing a downstream direction of the light-conducting tube and the LEDs arranged on the bottom face and essentially adjacent to an inner face of said segment of tube and distributed along a contour of the inner cross-section thereof; and a dissipating sleeve applied against the outer face of the segment of natural light-conducting tube, located at the level of the lamp; and a second segment of natural light-conducting tube, wherein the support body is attached by abutment between the two segments of the natural light-conducting tube, and wherein the dissipating sleeve is attached to the external edge of the support body.

18. The lighting device according to claim 10, wherein the support body defines a hoop and the width of the hoop is larger than the width of the empty inner space.

* * * * *